US006200007B1

(12) United States Patent
Minissi et al.

(10) Patent No.: US 6,200,007 B1
(45) Date of Patent: Mar. 13, 2001

(54) SUSPENDED LUMINAIRE ASSEMBLY

(75) Inventors: Paolo E. Minissi; Mark P. Boomgaarden, both of Austin, TX (US)

(73) Assignee: NSI Enterprises, Inc., Newark, OH (US)

( * ) Notice: Subject to any disclaimer, the term of this patent is extended or adjusted under 35 U.S.C. 154(b) by 0 days.

(21) Appl. No.: 09/238,699

(22) Filed: Jan. 27, 1999

(51) Int. Cl.[7] ..... F21V 29/00
(52) U.S. Cl. ..... 362/373; 362/285; 362/294
(58) Field of Search ..... 362/96, 218, 285, 362/294, 345, 373, 375, 391, 404, 407, 455, 456, 280, 281, 418

(56) References Cited

U.S. PATENT DOCUMENTS 2,171,116 * 8/1939 Muldoon ..... 362/294
5,121,309 * 6/1992 Ewing et al. ..... 362/375
5,136,489 * 8/1992 Cheng et al. ..... 362/294
5,791,768 * 8/1998 Splane, Jr. ..... 362/345

* cited by examiner

*Primary Examiner*—Y. Quach

(57) ABSTRACT

A luminaire assembly adapted for being suspended from an overhead location includes an electrical assembly having a housing with a longitudinal axis, a main housing portion, and an outwardly extending lower edge portion. It also includes an optical member having an interior surface and an upper opening. The interior surface includes an end wall disposed about the upper opening. The upper opening receives the elongated housing therethrough and is coaxial therewith, and also has a shape which corresponds to the elongated housing. In a suspended orientation for the luminaire assembly, the housing projects from the upper opening of the optical member so that the lower edge portion is adjacent to the end wall and extends around the upper opening for retaining and suspending the optical member. In a nested orientation the main housing portion of the elongated housing is disposed within the optical member so that the lower edge portion is distal the upper opening.

12 Claims, 6 Drawing Sheets

44
23
10
17
12
16
46
56
19
14

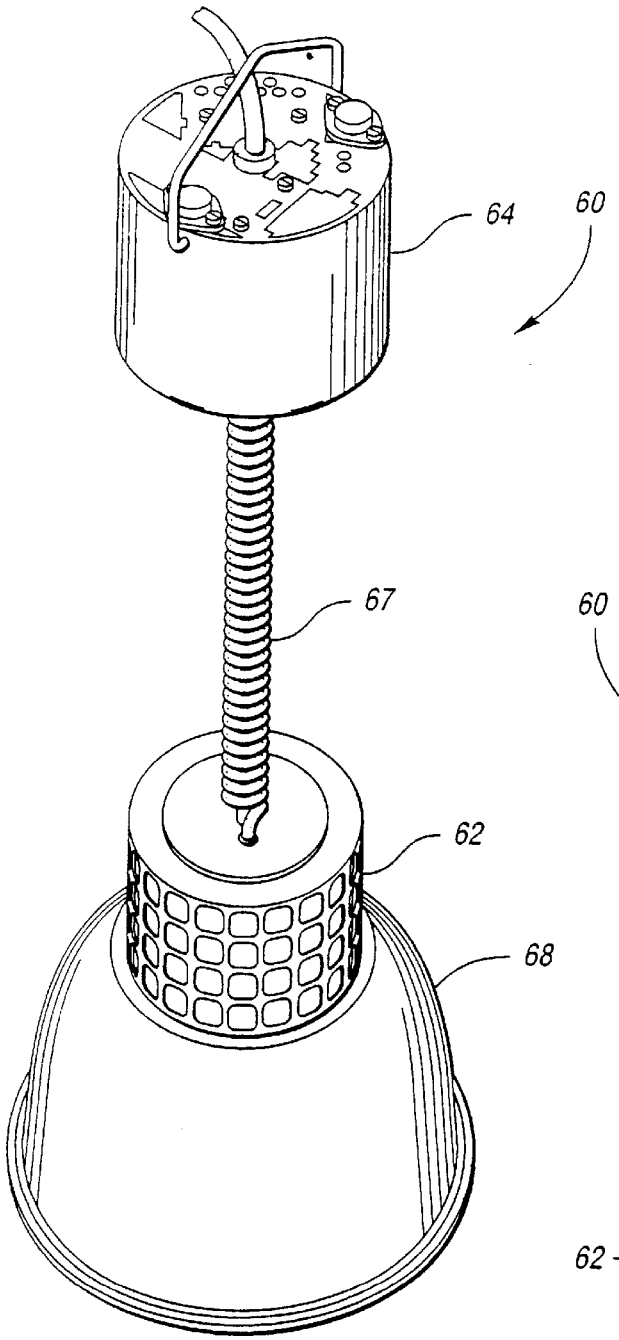
Fig. 4a
Fig. 4b
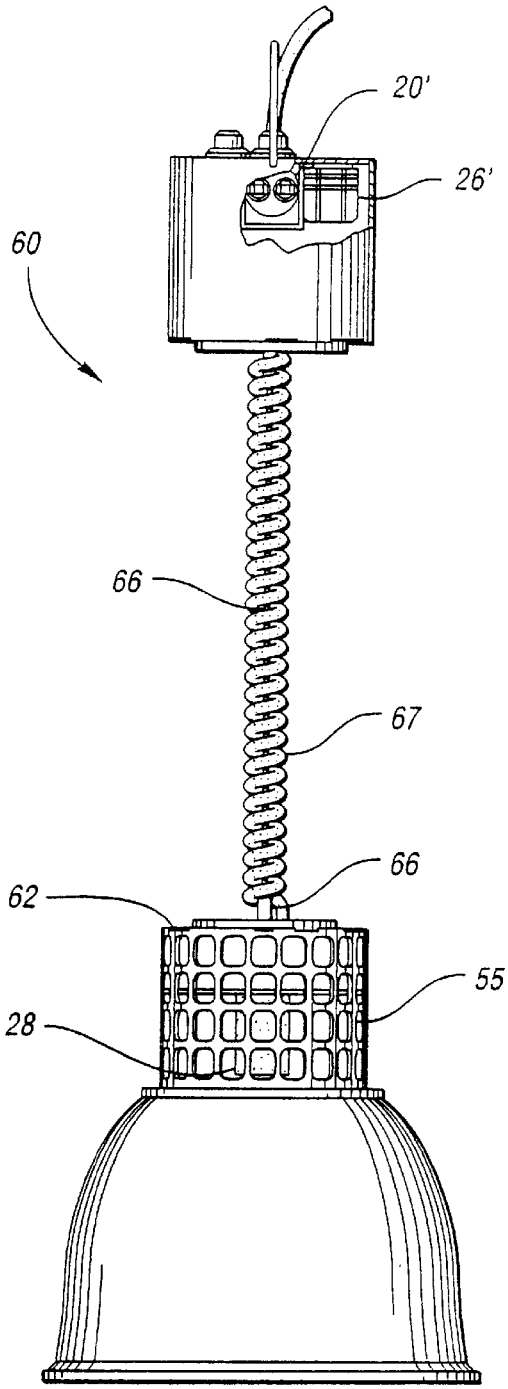

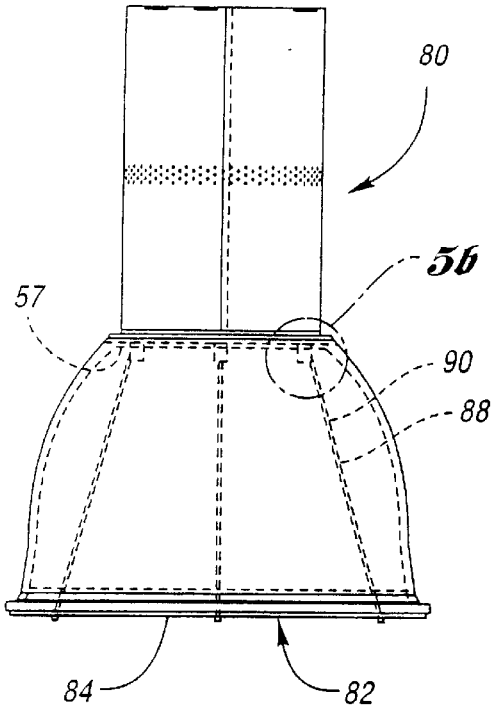
Fig. 5a
Fig. 5b
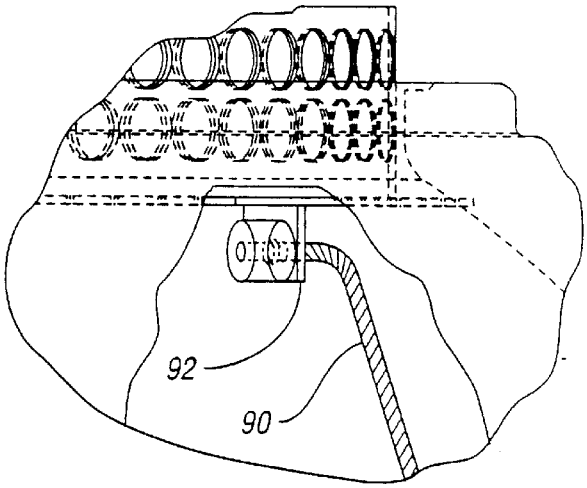
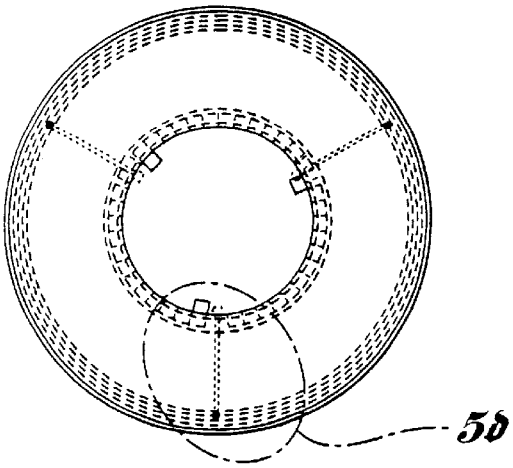
Fig. 5c
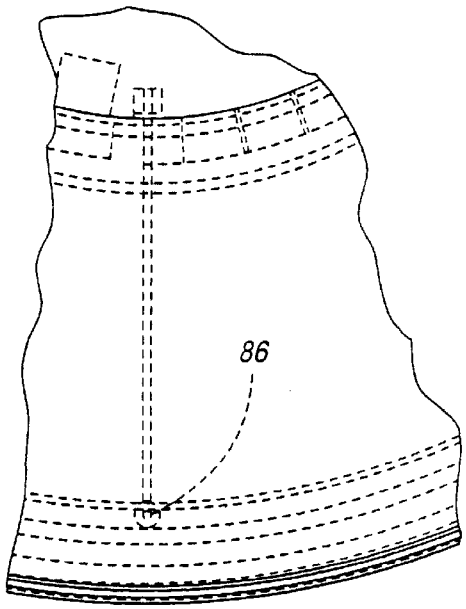
Fig. 5d

SUSPENDED LUMINAIRE ASSEMBLY

TECHNICAL FIELD

This invention relates to a luminaire assembly which is particularly suited for indoor applications.

BACKGROUND ART

Suspended luminaire assemblies typically include, among other components, an optical assembly which is typically formed of glass or plastic; an electrical assembly having a housing generally formed of metal for storing electrical components within; and a hanger member for suspending the luminaire from its intended overhead location. In order to protect these individual luminaire components, they are typically assembled, packaged, and shipped separately from each other from the point of manufacturing to the customer. This separation of components is done to reduce the risk of shipping damage caused by packaging an electrical component in the same container as a lighter or more fragile optical member. However, not only does this make the shipping and packaging process more costly and labor intensive for the manufacturer, it also increases expense for the customer at the installation site who must identify the various packages in order to find mating components, and then properly assemble and install these components in order to provide the desired lighting distribution. To complete these tasks, the installer often consults references for instruction. Moreover, the customer must often attach the hanger member to the electrical assembly and suspend it from the ceiling before installing the optical assembly to the rest of the luminaire assembly.

Further, most luminaire assemblies are assembled according to a customer specification so they may produce a desired light distribution. Such a customer specification typically requires coordinating and controlling the relative orientation of the electrical assembly with the optical assembly, which are attached via adjustable bracketry. Particularly, the lamp socket typically has a specific orientation relative to the optical assembly. Adjustments to this orientation often involve removing and reassembling multiple fasteners, repositioning and aligning brackets, and otherwise adjusting the relative positions of the electrical assembly, the socket and the optical assembly until the desired light distribution is achieved. All of these tasks are costly in terms of the great time and labor expended to accomplish them. Further, if these tasks are not performed properly, then the desired lighting distribution will not be achieved.

Moreover, because many indoor luminaire assemblies include a high intensity discharge (HID) lamp which produces a relatively large amount of heat, it may have an undesirable effect on the electrical assembly which contains heat sensitive electrical components, such as the capacitor. Portions of the lamp may reach temperatures of 1100° C. On the other hand, the ballast, capacitor, relay, starters and other electrical components found in a luminaire typically produce a relatively small amount of heat when compared to the lamp. For example, a typical capacitor has a maximum operating temperature of 90° C. Since the lamp is typically disposed in the socket which is oriented below and in close proximity to the electrical assembly housing, heat may be transferred from the lamp to the heat-sensitive electrical components contained in the housing.

In addition, while many luminaires have an open optical assembly (i.e., no barrier provided at the bottom), other luminaires are enclosed and have a bottom closure including a glass or plastic barrier (roundel) which is mounted to the optical assembly via a bezel or door, and often have a hinge or latch so that access to the lamp may be made convenient. The roundel provides a physical barrier between the lamp and the environment while permitting light to pass through. As with the other components, many enclosed luminaires are supplied to the customer with a bottom closure which must be attached to the optical member at the job site. Not only does this involve still more assembly cost and time by the customer, but the bezel may interfere with or block light distribution and reduce light efficiency. A typical bottom closure may also make replacing the lamp difficult.

Lastly, the aforementioned metal housing of the luminaire assembly is sometimes underutilized, and only used to contain and provide a mountable surface for the electrical components.

Consequently, there is a need for an improved luminaire assembly having reduced manufacturing, packaging and shipping costs and time for the manufacturer, as well reduced assembly, installation and labor cost and time for the customer. Further, the improved luminaire should have an electrical assembly and an optical assembly which assembly, install, and provide desired lighting distribution with minimal or no effort. The improved indoor luminaire assembly should also improve thermal isolation and reduce or eliminate the heat generated by the lamp from being transferred to the electrical components. The improved luminaire should also provide for an enclosed optical assembly which is less expensive for the manufacturer and for the customer to install. Further, the improved luminaire assembly should include an electrical assembly housing which may serve other desirable functions.

DISCLOSURE OF THE INVENTION

It is a principal object according the present invention to provide a luminaire assembly which involves reduced cost and time for the manufacturer from an assembly, packaging and shipping standpoint, and reduced cost and time for the customer in terms of installation, labor, and preparation time.

It is a further object according to the present invention to provide a luminaire assembly which provides improved thermal isolation for the electrical assembly components from the heat generating lamp.

It is still another object according to the present invention to provide a luminaire assembly which has a bottom enclosure which is less costly from an installation cost and labor standpoint.

It is yet still another object according the present invention to provide an electrical assembly housing which has additional functional and aesthetic attributes.

In carrying out the above objects, features and advantages of the present invention, provided is a luminaire assembly adapted for being suspended indoors. The luminaire assembly includes an electrical assembly and an optical assembly. The electrical assembly includes a housing with a longitudinal axis, a main housing portion, and an outwardly extending lower edge portion. The luminaire assembly also includes an optical member which has an interior surface and an upper opening. The interior surface includes an end wall disposed about the upper opening. The upper opening receives the housing therethrough and is coaxial therewith, and also has a shape which corresponds to the housing. In a suspended orientation for the luminaire assembly, the elongated housing projects from the upper opening of the optical member so that the lower edge portion is adjacent to the end wall and extends around the upper opening for retaining and suspending the optical member. In a collapsed or nested orientation the main housing portion of the housing is disposed within the optical member so that the lower edge portion is distal the upper opening. In a preferred embodiment, the housing has an elongated cylindrical shape and the upper opening has a corresponding annular shape.

In another embodiment, the luminaire assembly includes a bottom closure member for closing an annular lower opening of the optical member, the bottom closure member attached to the elongated housing by hanging members extending therebetween and disposed within the optical member. In another embodiment according to the present invention, the luminaire assembly includes a first and second housing portions which are spaced apart from the housing by an attachment member extending therebetween. In a preferred embodiment, the housing includes a plurality of vent perforations which are adjacent the ballast for venting heat generated by the ballast.

In yet another embodiment, the housing includes a plurality of illumination perforations adjacent the lower edge portion for providing a patterned outlet of illumination from the lamp through the housing. In one embodiment, each of the plurality of illuminating perforations has a shape selected from a group consisting of rectangles, squares, circles, triangles, stars, and crosses. In another embodiment, the plurality of illuminating perforations form a predetermined pattern for illuminating a given design.

In yet another embodiment according to the present invention, in the collapsed or nesting orientation the lower edge portion is co-planar with a lower opening of the optical member. In still another embodiment, a hanging member attached to the housing for hanging the luminaire assembly from an overhead support in the suspended orientation.

The above objects and other objects, features and advantages of the present invention are readily apparent from the following detailed description of the best mode for carrying out the invention when taken in connection with the accompanying drawings.

BRIEF DESCRIPTION OF DRAWINGS

FIG. 4*a* illustrates a perspective view of a second embodiment of the luminaire assembly according to the present invention, having an upper housing portion and a lower housing portion;

FIG. 4*b* illustrates a front elevational view of the second embodiment of the luminaire assembly according to the present invention;

FIG. 5*a* illustrates a front elevational view of a third embodiment of the luminaire assembly according to the present invention;

FIG. 5*b* illustrates a magnified view of the detail shown in FIG. 5*a* of the attachment to the housing of an attachment member of the third embodiment of the luminaire assembly according to the present invention;

FIG. 5*c* illustrates a bottom plan view of the third embodiment of the luminaire assembly according to the present invention;

FIG. 5*d* illustrates a magnified view of the detail shown in FIG. 5*c* of the luminaire assembly according to the present invention, showing the attachment member extending between the housing and the roundel.

BEST MODE FOR CARRYING OUT THE INVENTION

Figure 1:
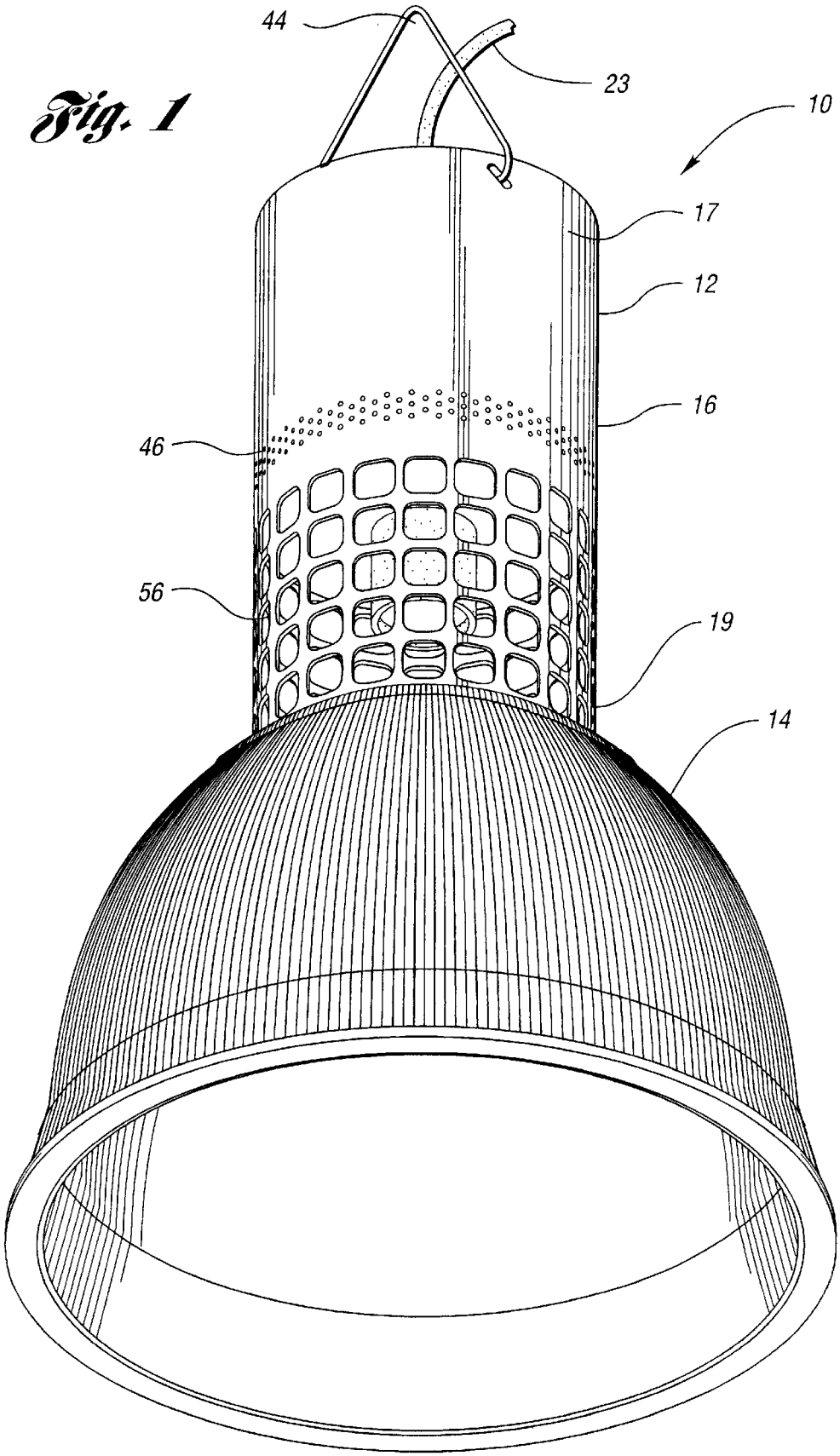
FIG. 1 is a perspective view of a first embodiment of the luminaire assembly according to the present invention.

With reference to FIG. 1 of the drawings provided herein, a luminaire assembly 10 according to the present invention is illustrated. Luminaire assembly 10 is particularly suited to indoor environments for retail and industrial applications, such as warehouses and open assembly areas. Luminaire assembly 10 includes an electrical assembly 12 (shown in detail in FIG. 2) and an optical assembly 14. Electrical assembly 12 has a housing 16 which is preferably formed of sheet metal (or other suitable material having sufficient strength and thermal stability for a light source), is less costly than aluminum castings often used for housings, and is functionally sufficient for the indoor environment to which the preferred embodiment of luminaire assembly 10 is directed because assembly 10 does not have to meet the demands of the often harsh outdoor environment. As further illustrated in FIGS. 1–3, housing 16 of electrical assembly 12 is preferably elongated (but not necessarily) and preferably has a shape or cross-section which is substantially cylindrical. As shown in FIG. 2, housing 16 defines at least one compartment or cavity 18 therein. Electrical assembly 12 further includes a capacitor 20, a ballast 22, and in another embodiment may include other electrical components such as a starter 24 and/or a relay 26. Capacitor 20 includes a heat deflecting cover 21. In general, ballast 22 is a mechanism used to provide necessary circuit conditions for starting and operating an electric-discharge lamp, such as the high intensity electric-discharge (HID) lamps referenced herein. Housing 16 of luminaire assembly 10 is sometimes relatively large due to the need for a relatively large surface area by which to dissipate ballast-generated heat.

Electrical assembly 12 further includes various electrical wiring, including wiring 23, and connections necessary to operate luminaire assembly 10, which are stored in housing 16 and are otherwise known in the art. As illustrated in FIG. 2, electrical assembly 12 also includes a socket 28 which receives a lamp 30 therein, and provides power thereto. Lamp 30 is preferably an HID light source, for example, of the Mercury, metal, halide, high pressure sodium, or low pressure sodium types. Electrical wiring (not shown) leading from socket 28 to ballast 22 and to other electrical components such as capacitor 20, is electrically connected according to circuit diagrams and configurations known to those skilled in the art to operate selected luminaires, lighting units and optical assemblies. As shown in FIGS. 1–3, in an assembled and suspended orientation, lamp 30 extends into optical assembly 14 and generates light for providing the desired lighting distribution.

As further shown in FIGS. 1 and 2, luminaire assembly 10 also includes optical assembly 14, which is shown as an optical member or unit 32 for directing light at angles of varying degrees according to the desired lighting distribution. It is contemplated that optical member 32 may be any glass, plastic or metallic member typical of those used in the art for distributing light, including but not limited to a glass or plastic reflector, refractor, a combination reflector/refractor, or a metallic reflector. Optical member 32 may have flutes and/or prisms for achieving such lighting distribution. Optical member 32 has an upper opening 34 at the top defined by the upper circumference 36 for receiving lamp 30 therethrough. Optical member also has an inner surface 33 and an outer surface 35. Interior surface 33 includes an end wall 57 (best shown in FIG. 5*a*) which is disposed about upper opening 34. Optical member 32 also has a lower opening 38 defined by the bottom circumference 40 through which downlight is provided to the environment in which luminaire assembly 10 is operating.

Figure 3A:
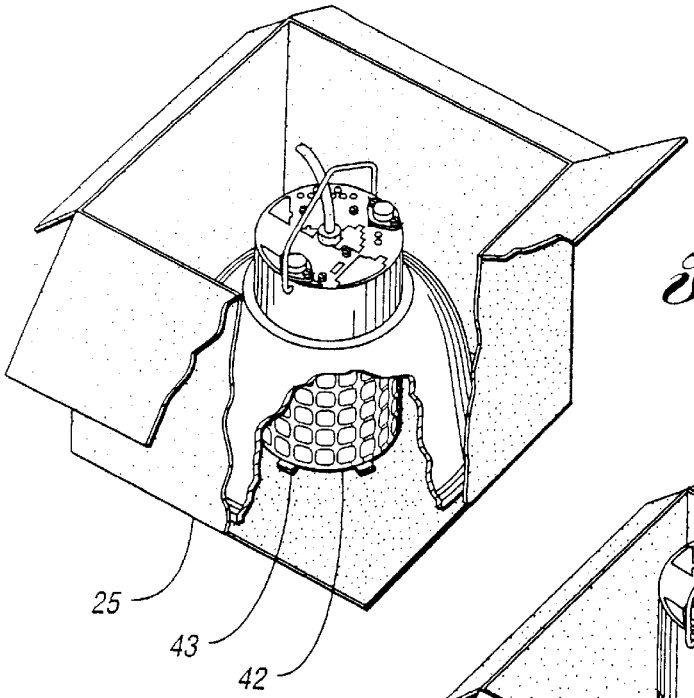
FIG. 3*a* is an illustration of a luminaire assembly according to the present invention shown in a nested orientation in a container, and having a broken away portion illustrating the nesting or collapsed orientation.
Figure 3C:
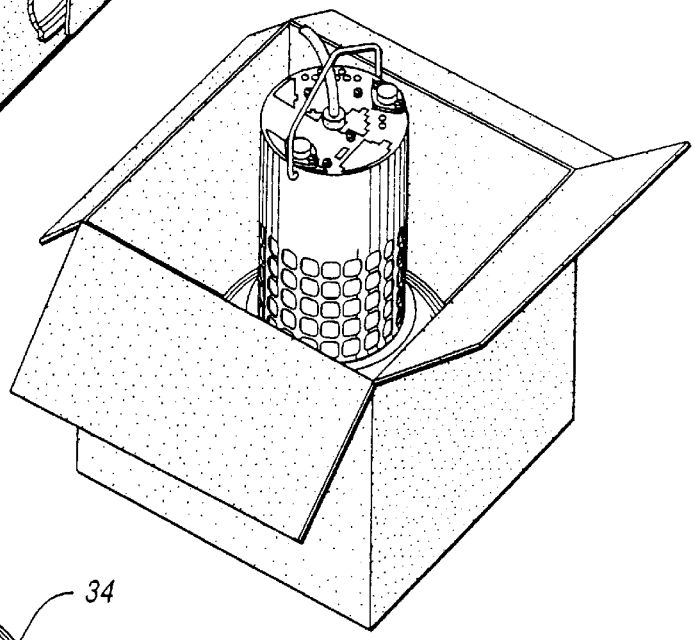
FIG. 3*c* is an illustration of a luminaire assembly according to the present invention shown in a telescoped orientation while disposed in the container.
Figure 3B:
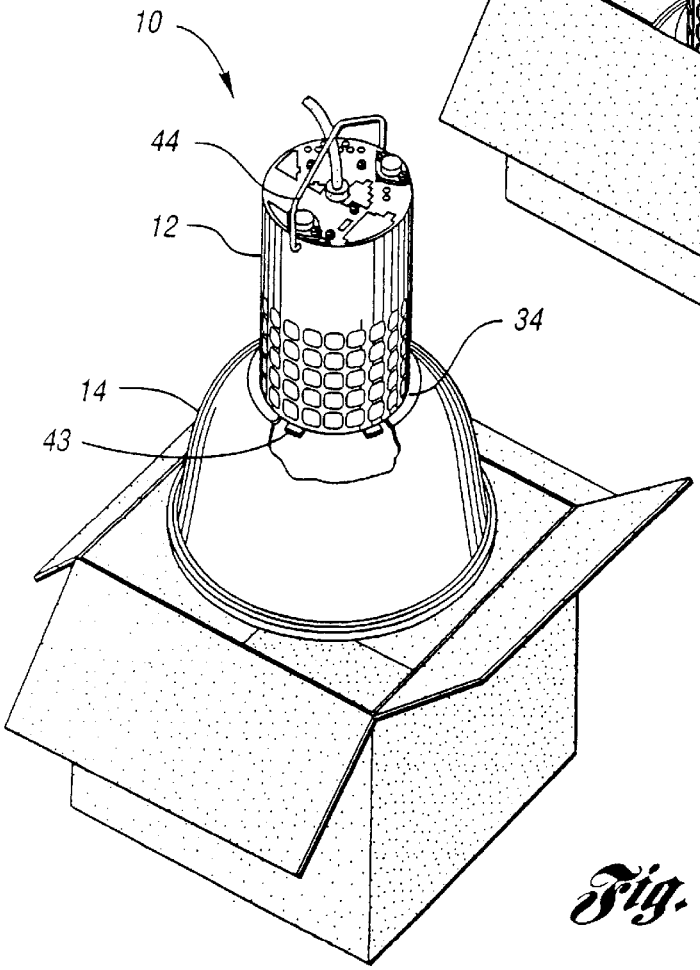
FIG. 3*b* is an illustration of a luminaire assembly according to the present invention shown in a fully telescoped or suspended orientation, and being lifted from the container.
Figure 6C:
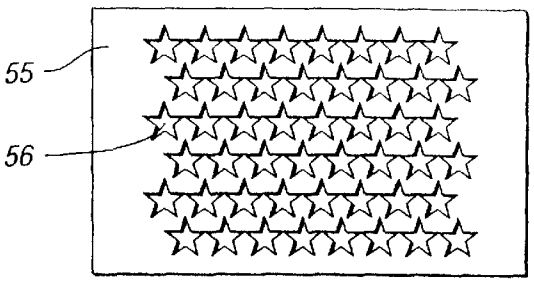
FIGS. 6*a*, 6*b*, 6*c*, 6*d*, 6*e*, 6*f*, 6*g*, and 6*h* illustrate various design embodiments for the pattern of illumination perforations according to the present invention.
Figure 6B:
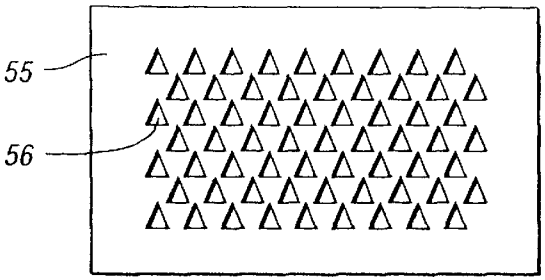
Figure 6A:
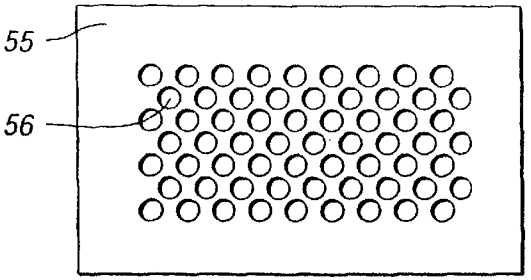
Figure 6F:
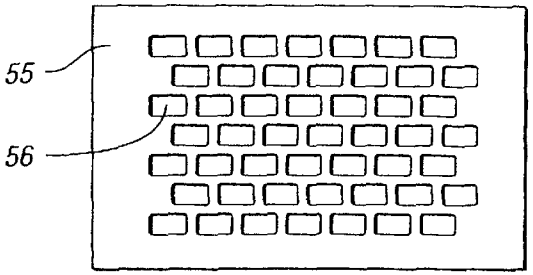
Figure 6E:
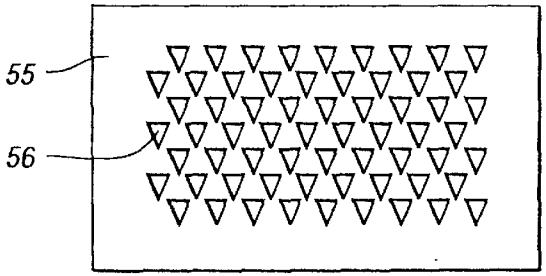
Figure 6D:
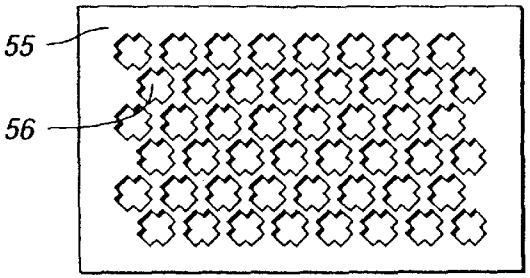
Figure 6H:
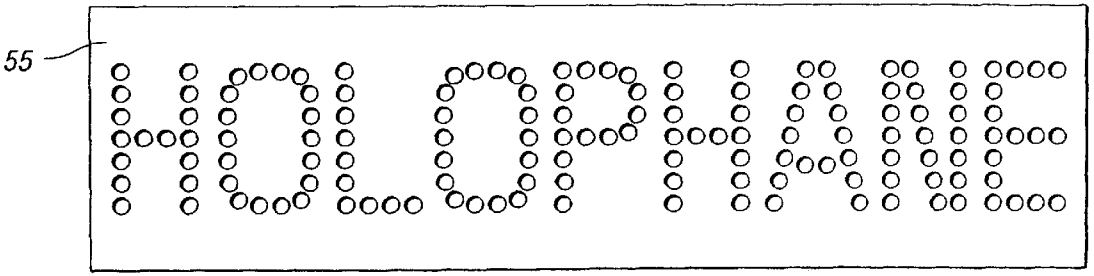
Figure 6G:
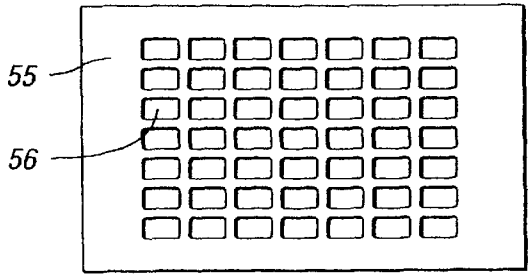

As shown in FIG. 1 and with further reference to FIGS. 3*a*–3*c*, upper opening 34 is sized to receive cylindrical housing 16 therethrough. This is particularly advantageous during assembly, packaging and shipping of luminaire assembly 10 by the manufacturer. As shown in FIGS. 3*a*–3*c*, at the time of manufacturing, luminaire assembly 10 is assembled as it will be used at installation. As such, during assembly, an upper portion 17 of cylindrical housing 16 is introduced through lower opening 38 of optical member 32 and inserted through upper opening 34. Accordingly, FIG. 3*a* shows luminaire assembly 10 in a container 25 as it is oriented during shipping (i.e, a nesting or collapsed orientation). Thus, as the broken away section of FIG. 3*a* illustrates, luminaire assembly 10 sits in container 25, a lower edge portion 42 of housing 16 is co-planar with bottom circumference 40 of optical member 32 and preferably has a flanged portion 43 outwardly extending from lower edge portion 42. Hanging member 44 may then be attached to upper portion 17 of housing 16. Further, in a nesting orientation shown in FIG. 3*a*, a main housing portion (approximately between lower housing portion 19 and upper housing portion 17) of elongated housing 16 is disposed within optical member 32 so that lower edge portion 42 is distal upper opening 34. In other words, housing 16 may be placed in container 25, lower edge portion 42 first, and subsequently optical member 32 may be introduced on top of it, bottom opening 38 end first, so that housing 16 is received through bottom opening 38 and upper opening 34. Again, hanging member 44 may then be attached to upper portion of housing 16 to allow the customer to lift the assembly to the suspended (or telescoped) orientation of FIGS. 3*b*–3*c*.

Figures 2A, 2B:
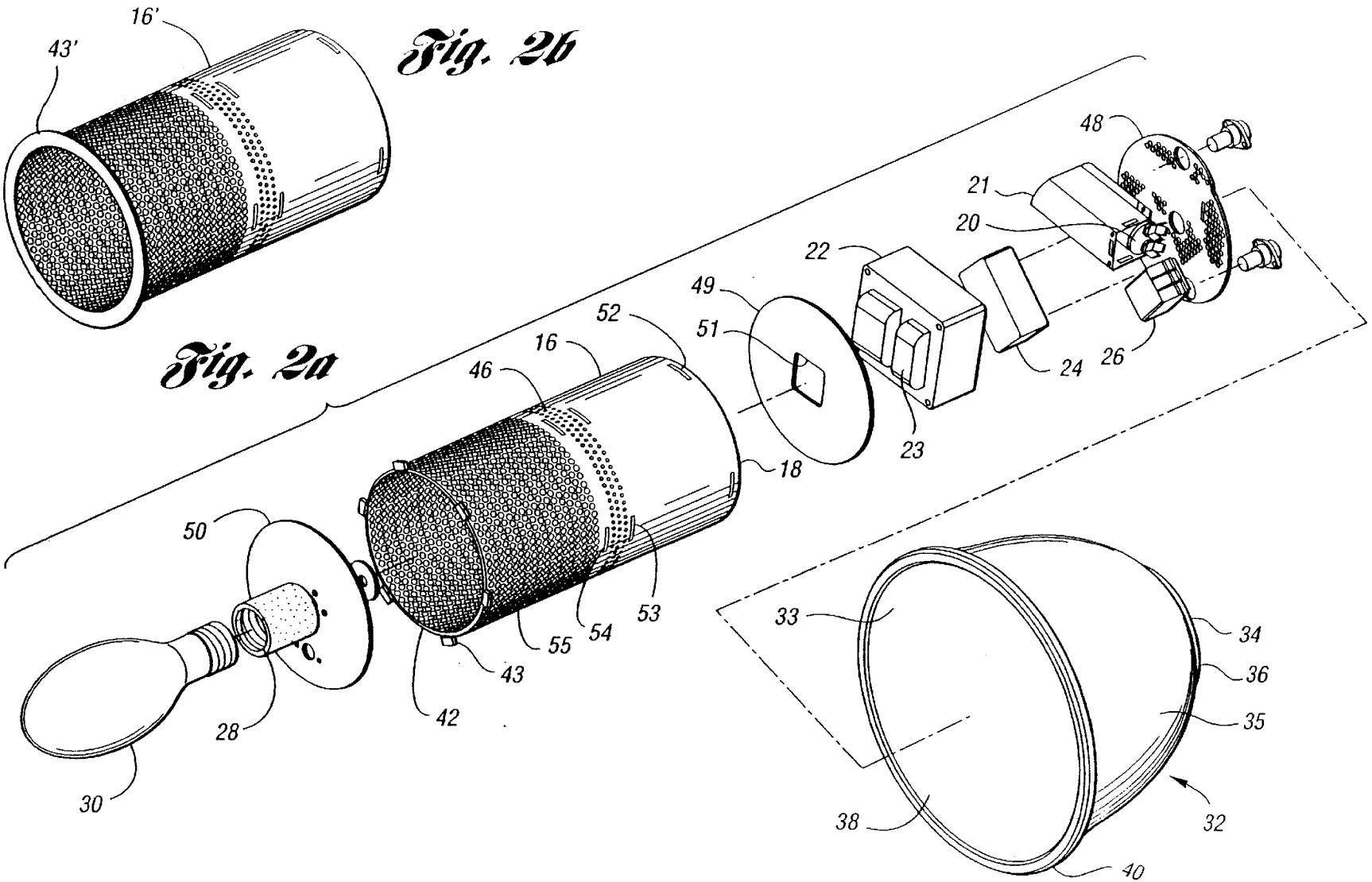
FIG. 2*a* is a perspective assembly diagram of the first embodiment of the luminaire assembly according to the present invention.
FIG. 2*b* illustrates another embodiment of the electrical assembly housing having a different flanged edge than that shown in FIG. 2*a*, according to the present invention.

As mentioned above, in a nesting orientation as shown in FIG. 3*a*, a portion of housing 16 is enveloped and surrounded by optical member 32, so that, for example, in a box or container 25 or during shipping, lower edge portion 42 of housing 16 and bottom circumference 40 are coplanar. Accordingly, as shown in FIG. 3*a*, luminaire assembly 10 may be packaged and shipped a single carton 25. The hanging member 44 is typically attached to electrical assembly 12 at the point of manufacturing. Optical assembly 14 includes an upper opening sized sufficiently to receive electrical assembly 12 therein. Depending on the manufacturing process used to form lower edge portion 42, it may include a continuous flange portion 43' as shown in FIG. 2*b* or flange portion 43 as shown in FIGS. 2*a* and 3*a*–3*b*. Of course, it is fully contemplated that flange portions may include any projection or separated tab which allows optical member 32 to be suspended from electrical assembly 12 as disclosed according to the present invention.

With reference now to FIGS. 3*b* and 3*c*, a telescoped or suspended orientation of luminaire assembly 10 is illustrated. Particularly in FIG. 3*b*, luminaire assembly 10 is shown out of container 25 as it would be oriented when lifted by an operator at handle 44 and ready to hang from an overhead location. Accordingly, elongated housing 16 projects from upper opening 34 of optical member 32 so that lower edge portion 42 of housing 16 is oriented adjacent upper opening 34. Again, via flanged portion 43, lower edge portion 42 has a diameter greater than that of upper opening 34 so that the optical member 32 is supported and suspended on flanged portion 43'. As is illustrated in FIGS. 1 and 3, while luminaire assembly 10 may be positioned in various orientations and locations indoors, it is preferably attached by suspending it from a ceiling or other overhead support by a hanging member 44 attached to the upper portion 17 of housing 16. FIG. 3*c* illustrates luminaire assembly 10 disposed in container 25, but in a telescoped orientation in which housing 16 is fully extended to full profile, while it is retained from being pulled completely through upper opening 34 of optical member 32 by the use of lower flange portion 43.

Accordingly, the manufacturer ships, and the customer receives, electrical assembly 10 nested within optical member 32 in container 25, as shown in FIG. 3*a*. To install luminaire assembly 10, the installer merely opens container 25 and, grasping hanging member 44, lifts in electrical assembly 12 in a telescoping manner, so that housing 16 is fully extended and projecting from upper opening 34, as shown in FIG. 3*c*. Finally, the installer completely lifts luminaire assembly 10 from container 25, where it is ready for hanging, as shown in FIG. 3*b*. As previously stated, in this orientation, optical member 34 is retained on housing 16 by way of bottom edge portion 42 of housing. Thus, this assembly 10 provides many advantages over prior designs, thereby allowing for not only a quicker and less costly assembly, packaging process, and shipping process by the manufacturer, but a markedly quicker and less costly installation by the customer, who only has to lift assembly 10 from its shipping container 25 and suspend it from its desired overhead support, so that it is fully operative without need for further adjustment.

Accordingly, without any further adjustment, luminaire assembly 10 may be suspended from an overhead location such as a ceiling by hanging member 44. In this fully extended position, housing 16 is prevented from being completely separated from optical assembly by flange portion 43 of housing 16, which engages the underside of optical assembly 14 (such as at end wall 57) and thereby retains optical assembly 14 thereon.

Thus, via the invention disclosed herein, optical assembly 14 is automatically assembled with electrical assembly 12 and, without any adjustment, is correctly positioned to a predetermined position relative to lamp socket 28 by the act of lifting luminaire assembly 10 from its container 25. This assures that the lighting distribution desired by the customer is automatically provided without the need for the customer to adjust and readjust the position of lamp socket 28 or optical assembly 14, or brackets, fasteners, and other parts used in the prior art to attach the housing to the optical assembly; and without the need to expend time and labor referring to instructions and diagrams for positioning these components according to the customer's desired lighting distribution.

With reference again to FIG. 2, housing 16 defines an internal chamber or cavity 18 therein wherein ballast 22 and capacitor 20 are located, in addition to any other components, electrical or otherwise, which may be convenient to locate within internal chamber 18, such as starter 24 and relay 26. Again, housing 16 is preferably made of sheet-metal, but may be made of any material of suitable strength which serves to dissipate the heat generated by ballast 22 during operation. Because lamp 30 tends to generate heat during operation which may be upwards of 1100° C., it is desirable to dissipate heat from cavity 18 before it reaches capacitor 20, starter 24, relay 26, and ballast 22. Particularly, the thermal limit on a typical capacitor is approximately 90° C. and on a typical ballast it is approximately 165° C. Accordingly, heat dissipated by lamp 30 is conducted and removed from housing 16 via a plurality of vent perforations 46 which allow such heat to be conducted to the outside environment and thus removed from housing 16. Housing 16 includes a plurality of vent perforations 46 adjacent ballast 22 for venting heat generated by ballast 22. These vent perforations 46 are preferably located along the length of housing 16 as shown and described herein.

With reference again to FIG. 2*a*, electrical assembly 12 includes three spaced apart plates, designated as an upper plate 48, intermediate plate 49, and lower plate 50. Upper plate 48 encloses upper end 17 of housing 16 and has affixed thereto capacitor 20, relay 24, and starter 26. Ballast 22 is attached to intermediate plate 49, which also has an opening formed 51 therein into which the coils 23 of ballast 22 are disposed when assembled. Lower plate 50 (or reflector plate) encloses housing 16 from the lower end, and has socket 28 affixed thereto. The surface of lower plate 50 from which socket 28 extends may preferably be formed of a relatively very high reflective and specular material in order to provide for increased reflection from this area, such as the material Miro 4™ (manufactured by Alanod Aluminium-Veredlung GmbH & Co., of Ennepetal, Germany.) Housing 16 also includes a first set 52, a second set 53, and a third set 54 of a plurality of co-planar slots, each set of slots (52, 53, 54) positioned in housing 16 in an annular orientation around the circumference of housing 16 for respectively receiving corresponding upper plate 48, intermediate plate 49, and lower plate 50, through which they are affixed to housing 16. As FIG. 2*a* illustrates, it is between intermediate plate 49 and lower plate 50 when assembled in housing 16 (or otherwise between second and third set of slots 53 and 54) that venting perforations 46 are located along housing 16.

In still other embodiments as illustrated in FIGS. 1, 2*a*–2*b*, 3*a*–3*c*, and 4*a*–4*b*, housing 16 includes a plurality of illumination perforations 55 in the lower portion 19 of housing 16 adjacent lower edge portion 42, for providing a patterned outlet of illumination from the lamp through housing 16. With reference to FIGS. 6*a*–6*h*, the plurality of illuminating perforations 55 may form any pattern, design or character string in housing 16, and is limited only by the imagination, and the size and stability of housing 16. Each individual perforation 56 may also have a variety of shapes, including but not limited to a square (FIG. 1), a circle (FIGS. 2, 6*a*, and 6*h*), a triangle having any given orientation (FIGS. 6*b* and 6*e*), a star (FIG. 6*d*), a cross or plus sign (FIG. 6*d*), or a rectangle (FIGS. 6*f*–6*g*), in a staggered (FIG. 6*f*) or other type of orientation. Of course, it is fully contemplated that each of these individual shapes may be used in any combination with any one or more of the other individual shapes. As mentioned, plurality of illumination perforations 55 may also include a design or a character string, such as the name "HOLOPHANE" illustrated in FIG. 6*h*.

A second embodiment of the luminaire assembly according to the present invention is shown in FIGS. 4*a*–4*b* as luminaire assembly 60. FIG. 4*a* illustrates a perspective view of this second embodiment, while FIG. 4*b* illustrates a front elevational view thereof. As illustrated in FIGS. 4*a*–4*b*, two spaced apart housing portions are provided, lower housing portion 62 and upper housing portion 64. Lower housing portion 62 includes lamp 30 and lamp socket 28, while upper housing portion 64 includes ballast 22, and other aforementioned heat-sensitive components. As further shown in FIG. 4*b*, housing portions 62 and 64 are physically separate in order to provide the desired thermal isolation of the heat generating lamp in socket 28 (extending from lower housing portion 62) apart from capacitor 20' and other electrical components stored in upper housing portion 64, including the ballast, relay, starter 26', as shown in the broken away section of upper housing portion 64. Accordingly, as these portions 62 and 64 are separated, venting perforations 46 shown in FIGS. 1 and 2 need not be used. Housing portions 62 and 64 are attached by an attachment member 66, which may include a stranded metal cable, or a solid rod, a chain, a spring, or fiberglass woven rope, etc. Of course, housing portions 62 and 64 are electrically connected with the appropriate wiring 67, shown winding circularly around attachment member 66. As with the first embodiment of luminaire assembly 10 shown and described herein, housing portions 62 and 64 are preferably cylindrical in shape. This luminaire assembly 60 incorporates all of the previously disclosed advantages of luminaire assembly 10. For example, with the appropriate packaging, luminaire assembly 60 may be packaged and shipped as a unit, with lower housing portion 62 nested within optical member 68, as disclosed in association with FIGS. 3*a*–3*c*. Luminaire assembly 60 may also include the illumination perforation patterns 55 disclosed in association with FIG. 6.

With reference now to FIGS. 5*a*–5*d*, illustrated therein is another embodiment showing luminaire assembly 80 according to the present invention. Luminaire assembly 80 is similar to the first embodiment of luminaire assembly 10, with the addition a bottom closure assembly 82, which is typically a tempered glass member 84 (or roundel) attached to housing 16 so as to provide adequate structural strength and protective capability while allowing maximum light output. The attachment is via a plurality of elongate suspension members 88 as shown in FIGS. 5*a*–5*d*, and is preferably via three small-diameter stranded metal cables 90, which are attached to roundel 84 and to housing 16 in such a way as to simultaneously center the roundel 84 in lower opening 38 of optical member 32 and on housing 16. Particularly, as shown in FIG. 5*d*, roundel 84 has a plurality of holes 86 formed therein for attaching cables 90 to roundel 84. Accordingly, three holes 86 are represented in this embodiment, corresponding to the number of cables 90 (FIGS. 5*c* and 5*d*). Further, as shown in FIG. 5*b*, cables are attached to housing 16 via a bracket assembly 92. Thus luminaire assembly 80 has advantages over the prior art, which used an annular metal band, bezel or door for attaching the roundel to the optical assembly, thereby blocking and interfering with the light distribution. Through this invention, minimal or no light is blocked by the use of cables 90, and the efficiency of luminaire 80 is increased thereby. Again, the advantages of the previous luminaire assembly embodiments apply equally hereto, and particularly to the nesting and suspending orientation advantages disclosed in association with FIGS. 3*a*–3*c*.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A luminaire assembly adapted for being suspended from an overhead location comprising:

an electrical assembly having a housing with sufficient strength and thermal stability for a light source, the housing further having a main housing portion and an outwardly extending lower edge portion; and an optical unit having an interior surface and an upper opening, the interior surface including an end wall disposed about the upper opening, the upper opening for receiving the housing through the upper opening and being coaxial with the housing, the upper opening further having a shape compatible with the housing, wherein in a suspended orientation the housing projects from the upper opening of the optical unit so that the lower edge portion is adjacent to the end wall and extends around the upper opening for retaining and suspending the optical unit, and wherein in a collapsed orientation the main housing portion of the housing is disposed within the optical unit so that the lower edge portion is distal from the upper opening.

2. A luminaire assembly adapted for being suspended indoors, comprising:

an electrical assembly having a housing with a longitudinal axis, a main housing portion, an outwardly extending lower edge portion, and a socket for receiving a lamp therein; and an optical member having an interior surface and an upper opening, the interior surface including an end wall disposed about the upper opening, the upper opening for receiving the housing through the upper opening and being coaxial with the housing, the upper opening further having a shape corresponding to the housing, wherein in a suspended orientation the housing projects from the upper opening of the optical member so that the lower edge portion is adjacent to the end wall and extends around the upper opening for retaining and suspending the optical member, and wherein in a nested orientation the main housing portion of the housing is disposed within the optical member so that the lower edge portion is distal from the upper opening.

3. The luminaire assembly of claim 2 wherein the housing has a cylindrical shape and the upper opening has a corresponding annular shape.

4. The luminaire assembly of claim 2 further comprising a bottom closure member for closing an annular lower opening of the optical member, the bottom closure member attached to the housing by suspension members extending therebetween and disposed within the optical member.

5. The luminaire assembly of claim 2 further comprising a second housing portion spaced apart from the housing by an attachment member extending therebetween, said second housing portion for storing electrical components therein.

6. The luminaire assembly of claim 2, wherein the housing includes a plurality of vent perforations for venting heat generated by the lamp.

7. The luminaire assembly of claim 2, wherein the housing includes a plurality of illumination perforations adjacent the lower edge portion for providing a patterned outlet of light distribution from the lamp through the housing.

8. The luminaire assembly of claim 7, wherein each of the plurality of illumination perforations has a shape selected from a group consisting of circles, triangles, stars, squares, rectangles, and crosses.

9. The luminaire assembly of claim 7, wherein the plurality of illumination perforations form a predetermined pattern for illuminating a given design.

10. The luminaire assembly of claim 2, wherein in a nest orientation, the lower edge portion is co-planar with a lower opening of the optical member.

11. The luminaire assembly of claim 2, further comprising a hanging member attached to the housing for hanging the housing from an overhead support in the suspended orientation.

12. A luminaire assembly adapted for suspension from an overhead location, comprising:

an electrical assembly including a cylindrical housing portion and a lower flanged edge portion; and an optical member having an annular upper opening for receiving the cylindrical housing through the annular upper opening, the optical member having an interior surface having an upper end wall surrounding the upper opening, wherein in a fully extended orientation the cylindrical housing projects from the upper opening of the optical member so that the lower flanged edge portion is adjacent to and encompasses the upper opening for retaining and suspending the optical member therefrom, and wherein in a nested orientation the cylindrical housing at least partially extends within the optical member so that the lower flanged edge portion is distal from the upper opening.

* * * * *